US010443264B1

(12) United States Patent
Son

(10) Patent No.: US 10,443,264 B1
(45) Date of Patent: Oct. 15, 2019

(54) DIGITAL DOOR LOCK ASSEMBLY

(71) Applicant: PHILIA TECHNOLOGY CO., LTD., Anyang-si, Gyeonggi-do (KR)

(72) Inventor: Koo Hyun Son, Seoul (KR)

(73) Assignee: PHILIA TECHNOLOGY CO., LTD., Anyang-si (KR)

( * ) Notice: Subject to any disclaimer, the term of this patent is extended or adjusted under 35 U.S.C. 154(b) by 0 days.

(21) Appl. No.: 16/109,743

(22) Filed: Aug. 23, 2018

(30) Foreign Application Priority Data

May 28, 2018 (KR) ..... 10-2018-0060646

(51) Int. Cl.

| | |
|---|---|
| ***E05B 9/08*** | (2006.01) |
| ***E05B 47/00*** | (2006.01) |
| ***G07C 9/00*** | (2006.01) |
| ***E05B 63/00*** | (2006.01) |

(52) U.S. Cl.

CPC ..... *E05B 9/08* (2013.01); *E05B 47/00* (2013.01); *E05B 63/0004* (2013.01); *G07C 9/00182* (2013.01); *E05B 2047/0091* (2013.01); *G07C 2009/0019* (2013.01)

(58) Field of Classification Search

CPC . E05B 9/08; E05B 9/082; E05B 9/084; E05B 47/00; E05B 63/0004; E05B 2047/0091; G07C 9/00182; G07C 2009/0019

USPC ..... 70/277, 278.1–278.3, 278.7, 279.1, 70/280–283, 283.1, 451, 461, 370, 371, 70/466; 292/144, DIG. 53, DIG. 60, 292/DIG. 64

See application file for complete search history.

(56) References Cited

U.S. PATENT DOCUMENTS

| | | | | |
|---|---|---|---|---|
| 5,337,588 | A * | 8/1994 | Chhatwal | E05B 17/22 264/264 |
| 6,826,937 | B2 * | 12/2004 | Su | E05B 9/082 70/107 |
| 2013/0031940 | A1 * | 2/2013 | Romero | E05B 37/00 70/278.1 |
| 2014/0041422 | A1 * | 2/2014 | Chiou | E05B 49/00 70/278.1 |
| 2014/0250956 | A1 * | 9/2014 | Chong | G07C 9/00174 70/278.1 |
| 2014/0260449 | A1 * | 9/2014 | Uyeda | E05B 47/00 70/266 |
| 2014/0260451 | A1 * | 9/2014 | Quach | E05B 47/0012 70/278.1 |
| 2014/0265359 | A1 * | 9/2014 | Cheng | E05B 55/12 292/144 |
| 2015/0096341 | A1 * | 4/2015 | Overgaard | E05B 47/02 70/283.1 |
| 2015/0114055 | A1 | 4/2015 | Frolov et al. | |

(Continued)

*Primary Examiner* — Lloyd A Gall

(57) ABSTRACT

A digital door lock assembly which includes an exterior assembly is disclosed. The exterior assembly includes a PCB which includes an RF chip for receiving and processing an RF signal, a controller chip for receiving and processing signals output from number keypads, and a regulator supplying an operating voltage to the RF chip and the controller chip, wires which are connected to the RF chip, the controller chip, and the regulator through the PCB, and a housing which has a storage space into which a key lock cylinder including a spindle and first screw holes is inserted, and includes a first hole and second holes that are formed at a bottom of the storage space SS and through which the spindle passes.

17 Claims, 11 Drawing Sheets

(56) References Cited

U.S. PATENT DOCUMENTS

| | | | | |
|---|---|---|---|---|
| 2017/0114570 | A1* | 4/2017 | Hallett | E05B 47/00 |
| 2018/0023320 | A1 | 1/2018 | McKibben et al. | |

* cited by examiner

DIGITAL DOOR LOCK ASSEMBLY

CROSS-REFERENCE TO RELATED APPLICATION

This application claims priority under 35 U.S.C. § 119 from Korean Patent Application No. 10-2018-0060646 filed on May 28, 2018, the disclosure of which is hereby incorporated by reference in its entirety.

TECHNICAL FIELD

Embodiments of the present inventive concept relate to a digital door lock assembly, and particularly to a digital door lock assembly which includes screw guides of various shapes in a structure of being connected to screw holes formed in a key lock cylinder, and adapters of various shapes in a structure of being connected to a spindle of the key lock cylinder.

DISCUSSION Of RELATED ART

A digital door lock refers to a device that opens and closes a door using a password, a card, or biometric information. The digital door lock is convenient to use as compared to a general door lock or a mechanical door lock, and is advantageous in that a door can be opened and closed using a password, a card, or biometric information even without having a key (or an emergency key), and therefore, it is widely used in homes or offices.

The digital door lock is classified into a keyed digital door lock that uses a key (or an emergency key) and a non-keyed digital door lock that does not use a key (or an emergency key).

When a user changes an existing general door lock (or a mechanical door lock) into a digital door lock, the user needs to work (or change) a door or drill a hole in accordance with an environment in which the digital door lock is installed. In addition, since the key lock cylinder of the existing general door lock installed at the door is incompatible with the digital door lock, the key lock cylinder cannot be re-used and has been discarded.

SUMMARY

A technical concept of the present inventive concepts is to provide a digital door lock assembly such that a user can reuse a key lock cylinder separated from a door, which includes screw guides having various shapes to be coupled with screw holes formed in the key lock cylinder, and adapters having various shapes to be coupled with a spindle of the key lock cylinder.

An exemplary embodiment of the present inventive concepts is directed to a digital door lock assembly including an exterior assembly, in which the exterior assembly includes a PCB which includes an RF chip for receiving and processing an RF signal, a controller chip for receiving and processing signals output from number keypads, and a regulator for supplying an operating voltage to the RF chip and the controller chip, wires which are connected to the RF chip, the controller chip, and the regulator through the PCB, and a housing which has a storage space into which a key lock cylinder including a spindle and a plurality of first screw holes is inserted, and includes a first hole through which the spindle passes and second holes, wherein the first hole and the plurality of second holes are formed at a bottom of the storage space.

An exemplary embodiment of the present inventive concepts is directed to a digital door lock assembly, including an exterior assembly which is installed outside a door, an inner plate assembly which is installed inside the door and connected to the exterior assembly, an interior assembly which is connected to the inner plate assembly, a first screw guide, a second screw guide, first screws, a first adapter, and a second adapter, in which the exterior assembly includes a PCB that includes an RF chip for receiving and processing an RF signal, a controller chip for receiving and processing signals output from number keypads, and a regulator for supplying an operating voltage to the RF chip and the controller chip, wires that are connected to the RF chip, the controller chip, and the regulator through the PCB, and a housing that has a storage space into which a key lock cylinder including a spindle and first screw holes is inserted, and includes a first hole through which the spindle passes and second holes.

The first screw guide includes third holes each having a circular shape, the second guide includes fourth holes each having an elliptical shape, the first adapter includes a fifth hole through which the spindle passes, the second adapter includes a sixth hole through which the spindle passes, the first hole and the second holes are formed at a bottom of the storage space, the first screws screw the first screw guide into the first screw holes of the key lock cylinder through the third holes and the second holes when the first screw guide is used, the first screws screw the second screw guide into the first screw holes of the key lock cylinder through the fourth holes and the second holes when the second screw guide is used, the spindle passes through the first hole and the fifth hole when the first adapter is used, and the spindle passes through the first hole and the sixth hole when the second adapter is used.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE EMBODIMENTS

Figure 1:
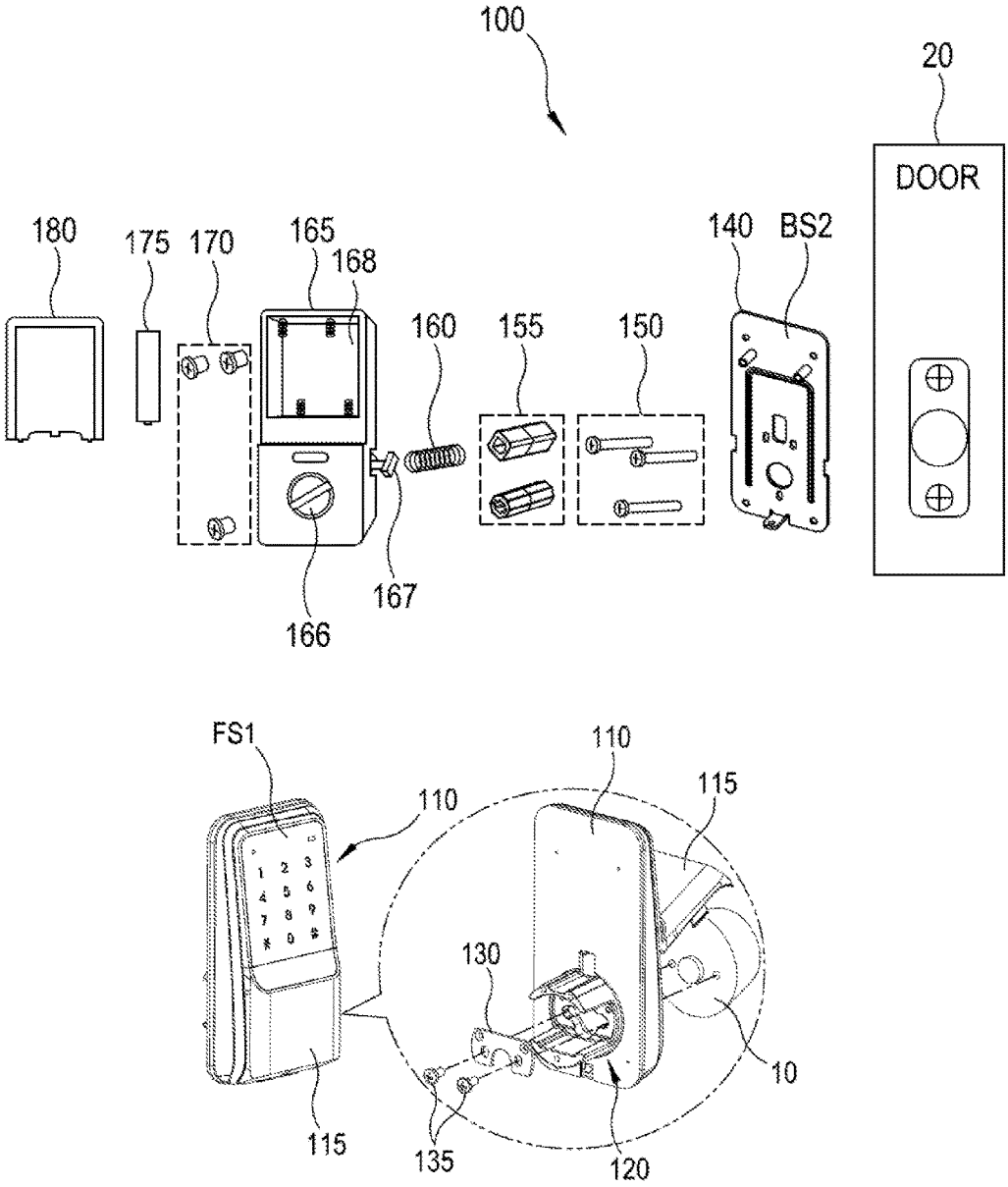
FIG. 1 shows a digital door lock assembly according to exemplary embodiments of the present inventive concepts.

Reference will now be made in detail to the embodiments of the present general inventive concept, examples of which are illustrated in the accompanying drawings, wherein like reference numerals refer to the like elements throughout.

The embodiments are described below in order to explain the present general inventive concept by referring to the figures.

Figure 2:
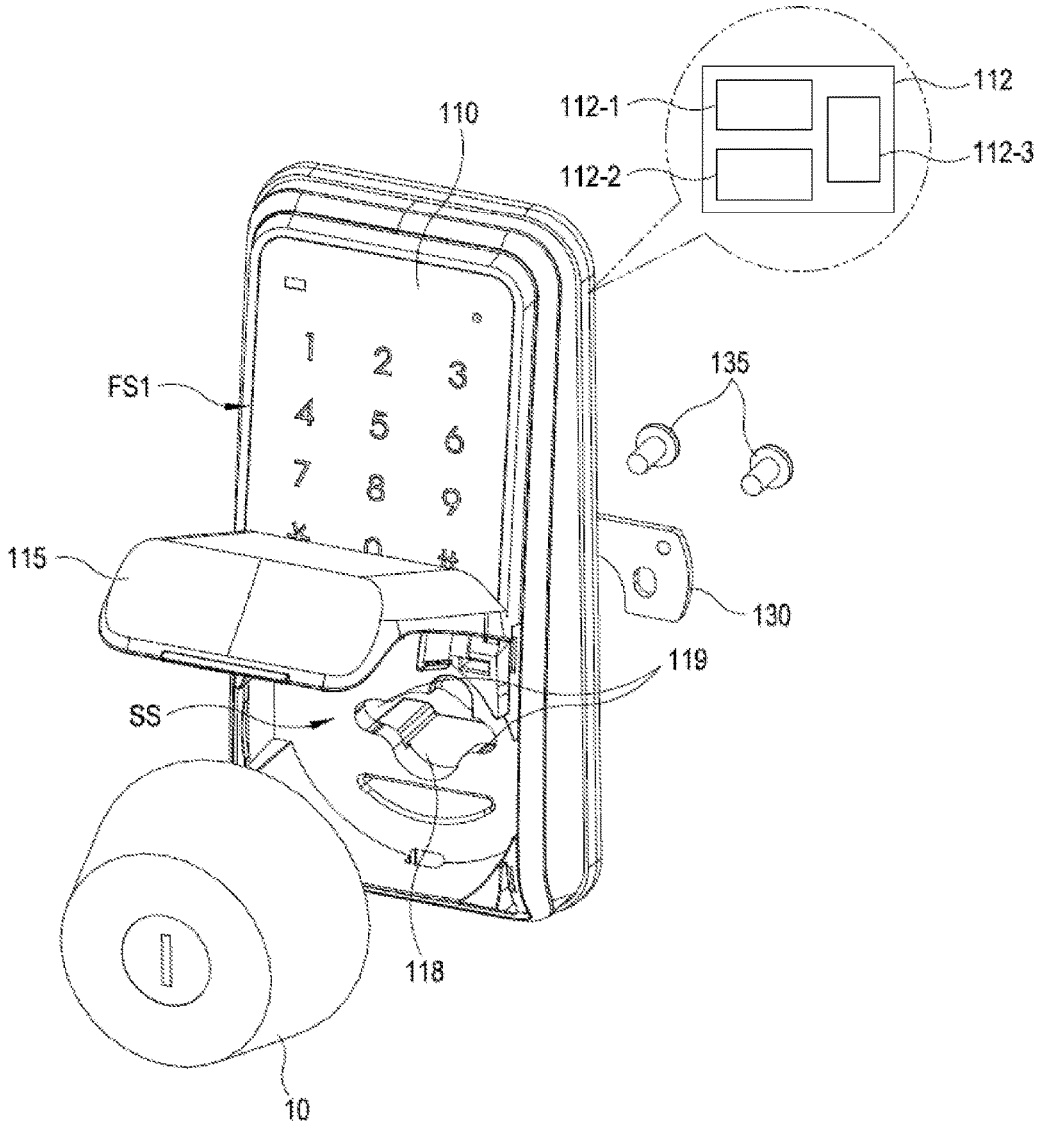
FIGS. 2 and 3 are views showing a process of coupling a key lock cylinder and a screw guide to an exterior assembly of the digital door lock assembly of FIG. 1.
Figure 3:
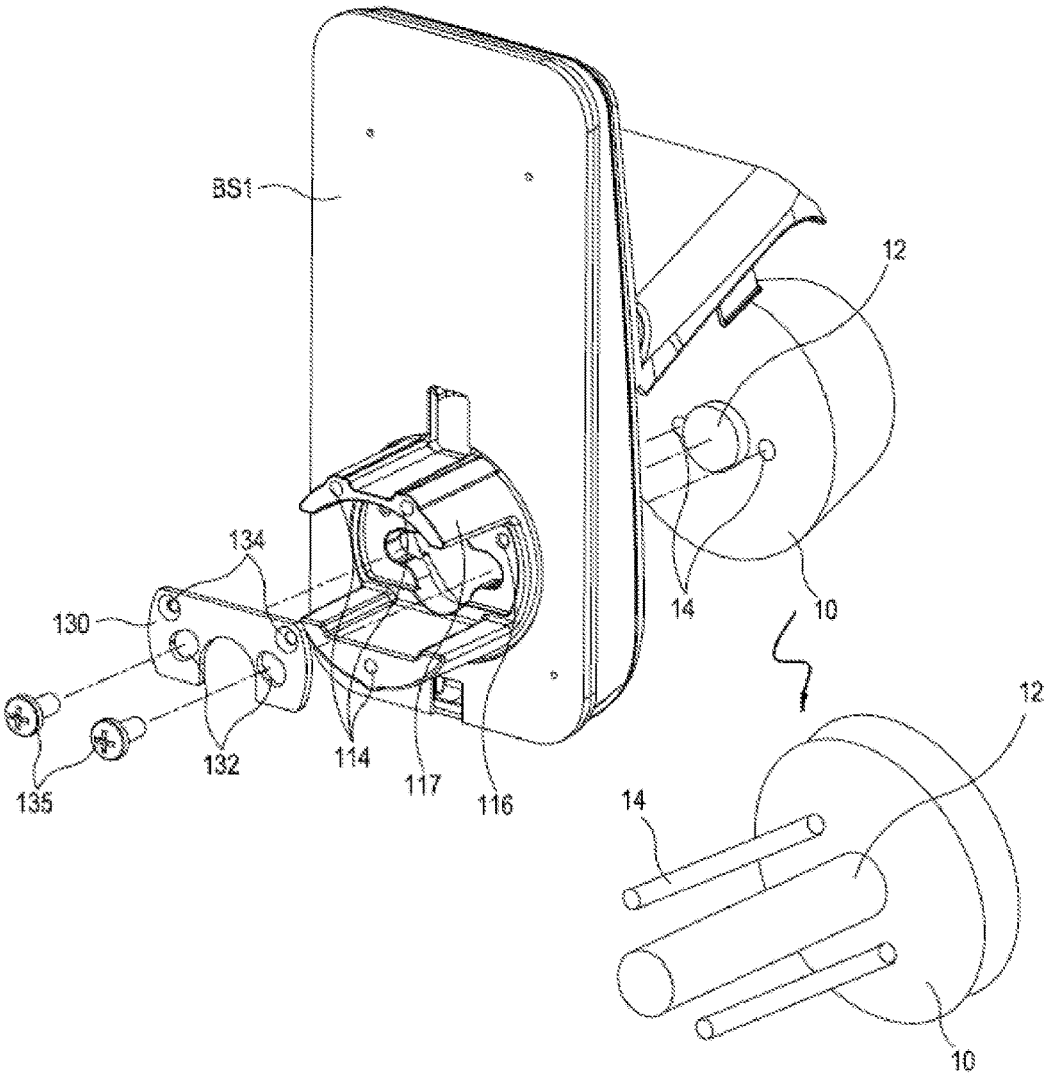

FIG. 1 shows a digital door lock assembly according to exemplary embodiments of the present inventive concepts, and FIGS. 2 and 3 are views showing a process of coupling a key lock cylinder and a screw guide to an exterior assembly of the digital door lock assembly of FIG. 1.

Referring to FIG. 1, a digital door lock assembly 100 may include an exterior assembly 110, a plurality of screw guides 130, a plurality of first screws 135, an inner plate assembly 140, a plurality of second screws 150, a plurality of adapters 155, a compression spring 160, an interior assembly 165, a plurality of third screws 170, at least one battery 175, and a battery cover 180. According to exemplary embodiments, the digital door lock assembly 100 may or may not include a key lock cylinder 10.

The digital door lock assembly 100 may be referred to as a digital door lock, an electronic door lock, an electronic digital door lock, a lockset, or the like; however, the present inventive concepts are not limited thereto. The digital door lock assembly 100 has a structure of being applicable to a door 20 with a thickness of 35 mm to 55 mm, but the present inventive concepts are not limited thereto.

The exterior assembly 110 may be attached to the exterior (or the exterior surface) of the door 20, and a printed circuit board (PCB) 112 may be included (or embedded) therein as shown in FIG. 2. The PCB 112 of FIG. 2 may include an RF chip 112-1 for receiving and processing an RF signal input through a radio frequency (RF) card input area, a controller chip 112-2 for receiving and processing signals output from number keypads (or key buttons), and a regulator 112-3 for supplying an operating voltage to the RF chip 112-1 and the controller chip 112-2.

The exterior assembly 110 may further include wires (or PCB patterns) electrically connected to the RF chip 112-1, the controller chip 112-2, and the regulator 112-3 through the PCB 112.

A housing having a storage space (SS) into which the key lock cylinder 10 including a spindle 12 and first screw holes 14 is inserted is formed on a front surface FS1 of the exterior assembly 110, and a first hole 118 through which the spindle 12 passes (or penetrate) and a plurality of second holes 119 are formed at the bottom of the storage space SS or the bottom of the housing. The spindle 12 may be referred to as a key tail or a rotatable shaft.

The first screw holes 14 are metal parts with holes, and threads for screwing corresponding screws (or bolts) are formed on the surfaces of the holes. Accordingly, the first screw holes 14 may refer to nuts and the first screw holes 14 may refer to elongate tubular support members or holes formed in screw posts.

Even if the cylindrical spindle 12 is shown in FIGS. 1 and 3, the spindle 12 may be embodied as a split spindle, a set screw spindle, a threaded spindle, a swivel spindle, or a rigid spindle according to exemplary embodiments, and a cross section (or shape) of the spindle 12 may be embodied as a D type, a (+) type, or a (−) type depending on a manufacturer of the key lock cylinder 10 or the spindle 12; however, the present inventive concepts are not limited thereto.

As shown in FIG. 3, the length of the spindle 12 may be long enough to be inserted (coupled) into the adapter 155 by passing through (or through) the exterior assembly 110, the door 20, and the inner plate assembly 140.

As shown in FIG. 2, a part of the first hole 118 and a part of each of the plurality of second holes 119 may be connected to each other.

A front cover 115 for protecting the key lock cylinder 10 inserted into the storage space SS may be further formed on the front surface FS1 of the exterior assembly 110. The front cover 115 may be embodied in plastic, but the present inventive concepts are not limited thereto.

The protruding portion 120 may be formed on a back surface BS1 of the exterior assembly 110, and the second screw holes 114 may be formed in or on the chassis 117 of the protruding portion 120. The protruding portion 120 or the chassis 117 may be inserted into a face bore hole of the door 20. Third screw holes 116 may be further formed on the back surface BS1 of the exterior assembly 110.

Each structure of a plurality of screw guides (or adjusting plates) 130 will be described with reference to FIGS. 4 to 6. The digital door lock assembly 100 includes three types of screw guides 130A, 130B, and 130C (collectively 130) shown in FIGS. 4 to 6. Any one of the three types of screw guides 130A, 130B, and 130C, which is selected by a user, may screw into the first screw holes 14 of the key lock cylinder 10 using the first screws 135.

Figure 4:
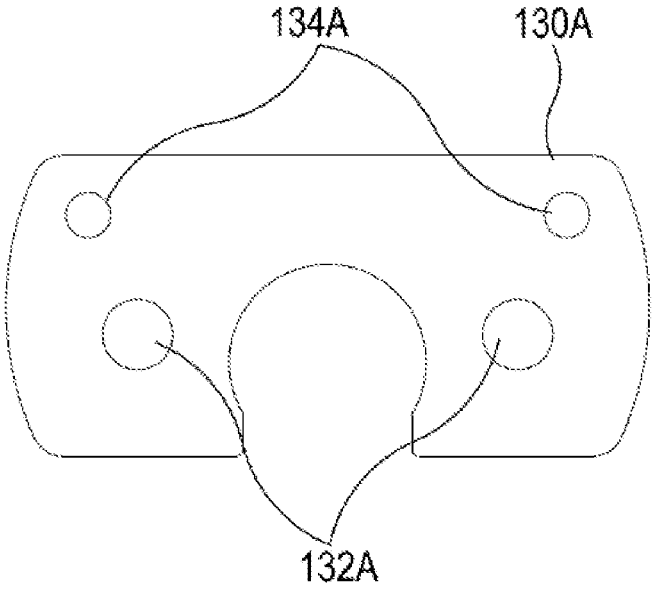
FIGS. 4 to 6 are exemplary embodiments of screw guides included in the digital door lock assembly of FIG. 1.

As shown in FIG. 4, a first screw guide 130A may include third holes 132A, and may further include fourth holes 134A according to exemplary embodiments. The spindle 12 which has passed through the first hole 118 can pass through an empty space of an arch portion of the first screw guide 130A.

When the first screw guide 130A among the screw guides 130A, 130B, and 130C is used in the digital door lock assembly 100, the first screws (or bolts) 135 may screw the first screw guide 130A into first screw holes (or nuts 14) of the key lock cylinder 10 through (or by passing through) third holes 132A and the second holes 119. Fourth screws may screw the first screw guide 130A into the third screw holes 116 through the fourth holes 134A. Each of the third holes 132A may be formed in a circular shape.

Figure 5:
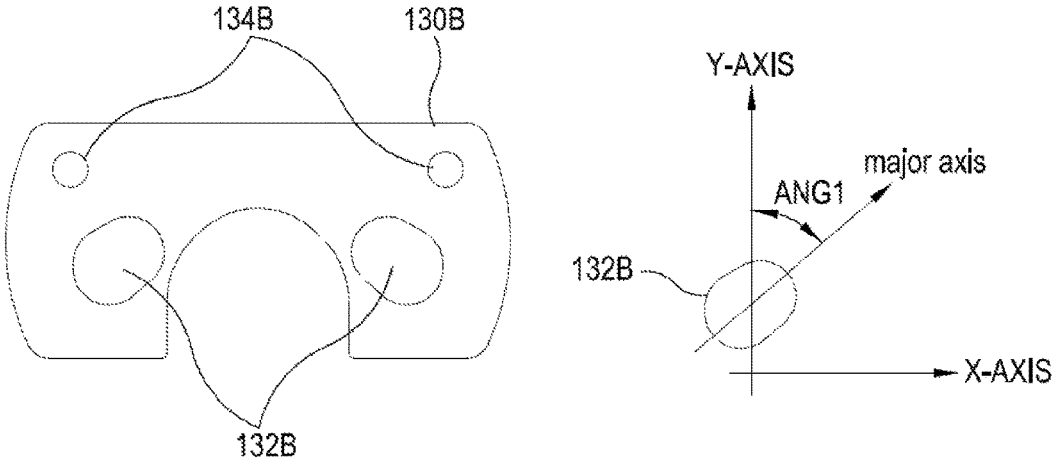

As shown in FIG. 5, a second screw guide 130B may include fifth holes 132B, and may further include sixth holes 134B according to exemplary embodiments.

The second screw guide 130B among the screw guides 130A, 130B, and 130C is used in the digital door lock assembly 100, the first screws 135 may screw the second screw guide 130B into the first screw holes 14 of the key lock cylinder 10 through (or by passing through) the fifth holes 132B and the second holes 119. The fourth screws may screw the second screw guide 130B into the third screw holes 116 through the sixth holes 134B.

Each of the fifth holes 132B may be formed in an elliptical shape having a minor axis and a major axis, and an angle ANG1 between a vertical axis (or a Y-axis) and the major axis of the elliptical shape may be 35° to 45°. The spindle 12 which has passed through the first hole 118 may pass through an empty space of an arch portion of the second screw guide 130B.

Figure 6:
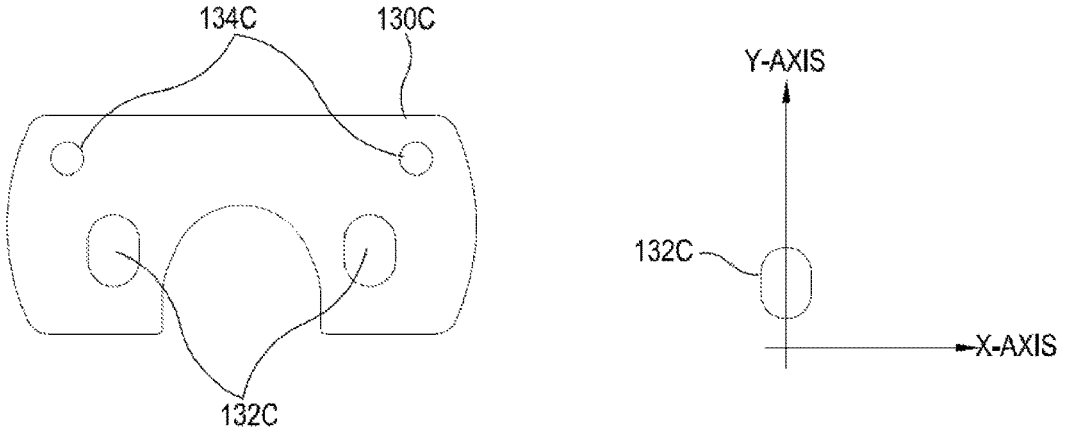
Figure 7:
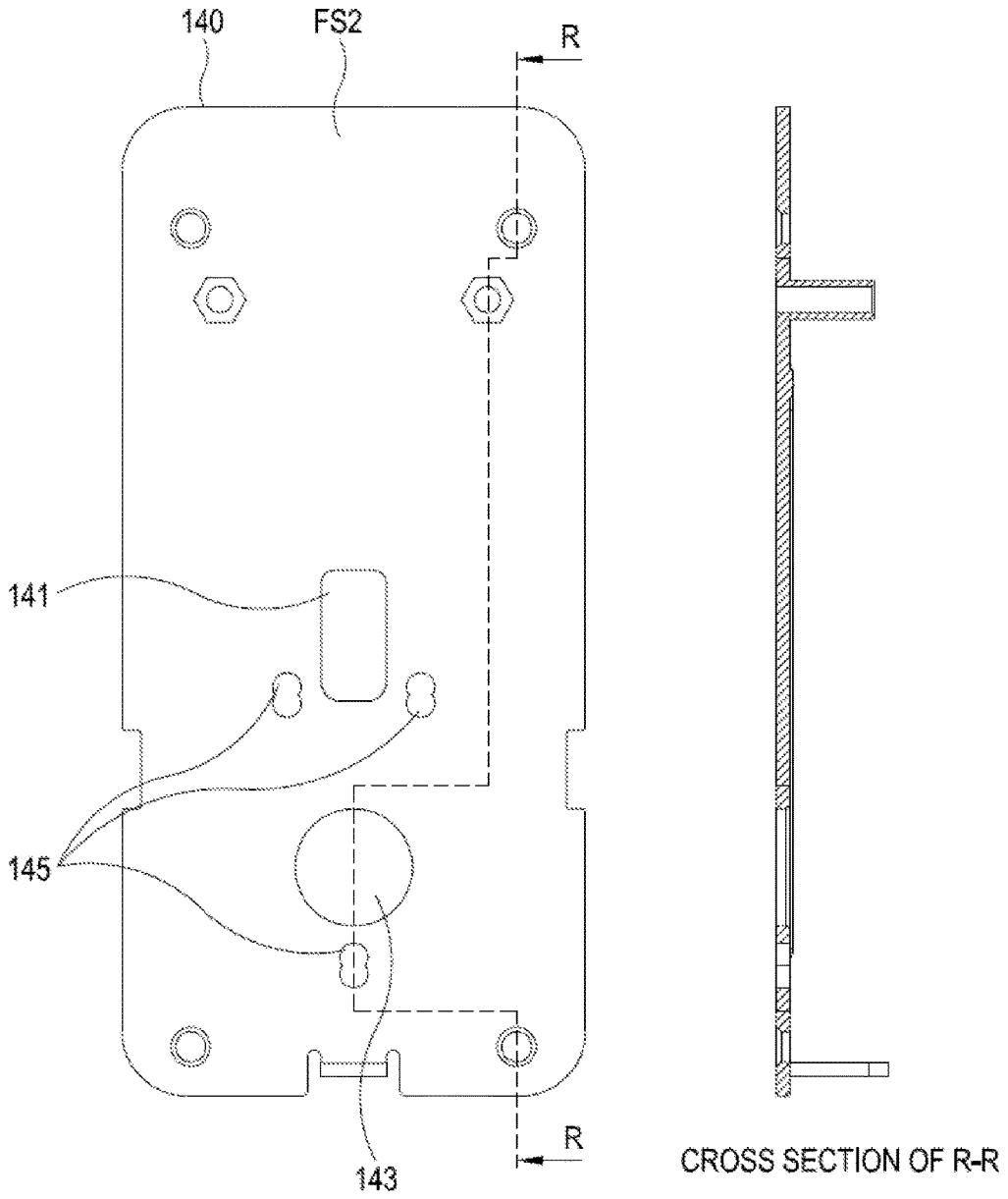
FIG. 7 shows an inner plate assembly of the digital door lock assembly of FIG. 1.

As shown in FIG. 6, a third screw guide 130C may further include seventh holes 132C, and may further include eighth holes 134C according to exemplary embodiments.

When the third screw guide 130C among the screw guides 130A, 130B, and 130C is used in the digital door lock assembly 100, the first screw 135 may screw the third screw guide 130C into the first screw holes 14 of the key lock cylinder 10 through (or by passing through) the seventh holes 132C and the second holes 119. The fourth screws may screw the third screw guide 130C into the third screw holes 116 through the eighth holes 134C. Each of the seventh holes 132C may be formed in an elliptical shape having a minor axis and a major axis, and the major axis of the elliptical shape may be in parallel with the vertical axis (or the Y-axis).

The door lock assembly 100 of the present inventive concepts includes three types of screw guides 130A, 130B, and 130C, and, when a user intends to reuse an existing key lock cylinder 10 separated from the door 20, the user may couple (or insert) the existing key lock cylinder 10 with the exterior assembly 110 by selecting one of the three-types of screw guides 130A, 130B, and 130C.

As a result, the user can reuse the existing key lock cylinder 10, and does not need to drill an additional hole in the door 20 and/or a door frame to install the door lock assembly 100 including the key lock cylinder 10 in the door 20.

The inner plate assembly 140 includes a front surface FS2 and a back surface BS2, the front surface FS2 is connected to the exterior assembly 110 through the door 20, and the back surface BS2 is connected to the interior assembly 165.

The inner plate assembly 140 includes a ninth hole 141, a tenth hole 143, and eleventh holes 145. The ninth hole 141 is a hole for a cable (or wires) for transmitting signals output from the PCB 112 included in the exterior assembly 110 to a main controller included in the interior assembly 165, the tenth hole 143 is a hole for causing the spindle 12 of the key lock cylinder 10 to pass therethrough, and the eleventh holes 145 are holes corresponding to the second screw holes 114.

The second screws (or bolts) 150 may screw into the second screw holes 114 through the eleventh holes 145. As a result, the inner plate assembly 140 and the exterior assembly 110 may be coupled with each other by the second screws 150 screwing into the second screw holes 114.

Each of the eleventh holes 145 is a peanut-shaped hole. As the peanut-shaped holes 145 are formed in the inner plate assembly 140, even if the second screw holes 114 are formed at different positions depending on a manufacturer, a user can fix the inner plate assembly 140 to the exterior assembly 110 using corresponding screws.

Figure 8:
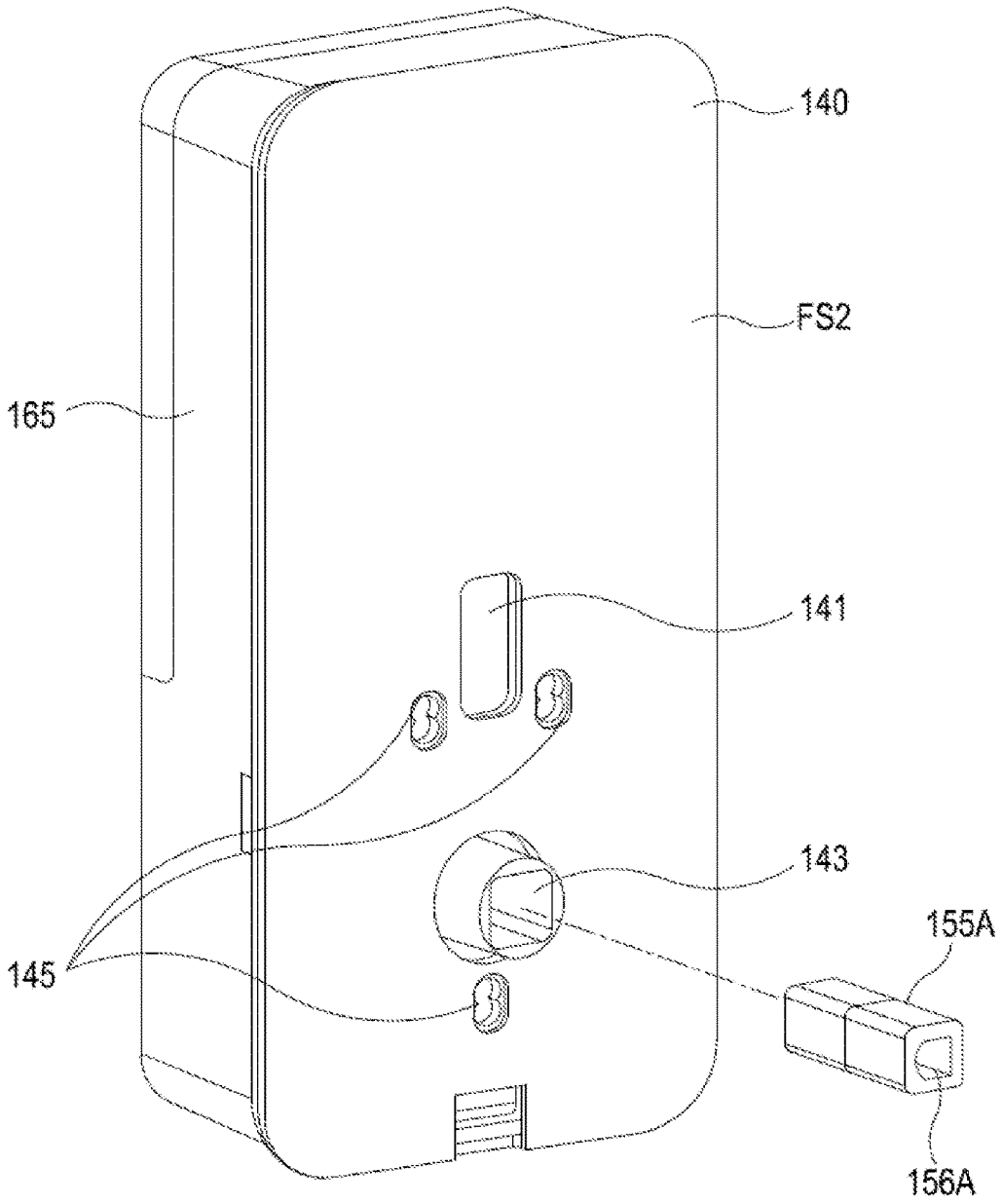
FIGS. 8 and 9 are views which describe a process of connecting an adapter to an inner plate assembly which is coupled with an interior assembly of the digital door lock assembly of FIG. 1.
Figure 9:
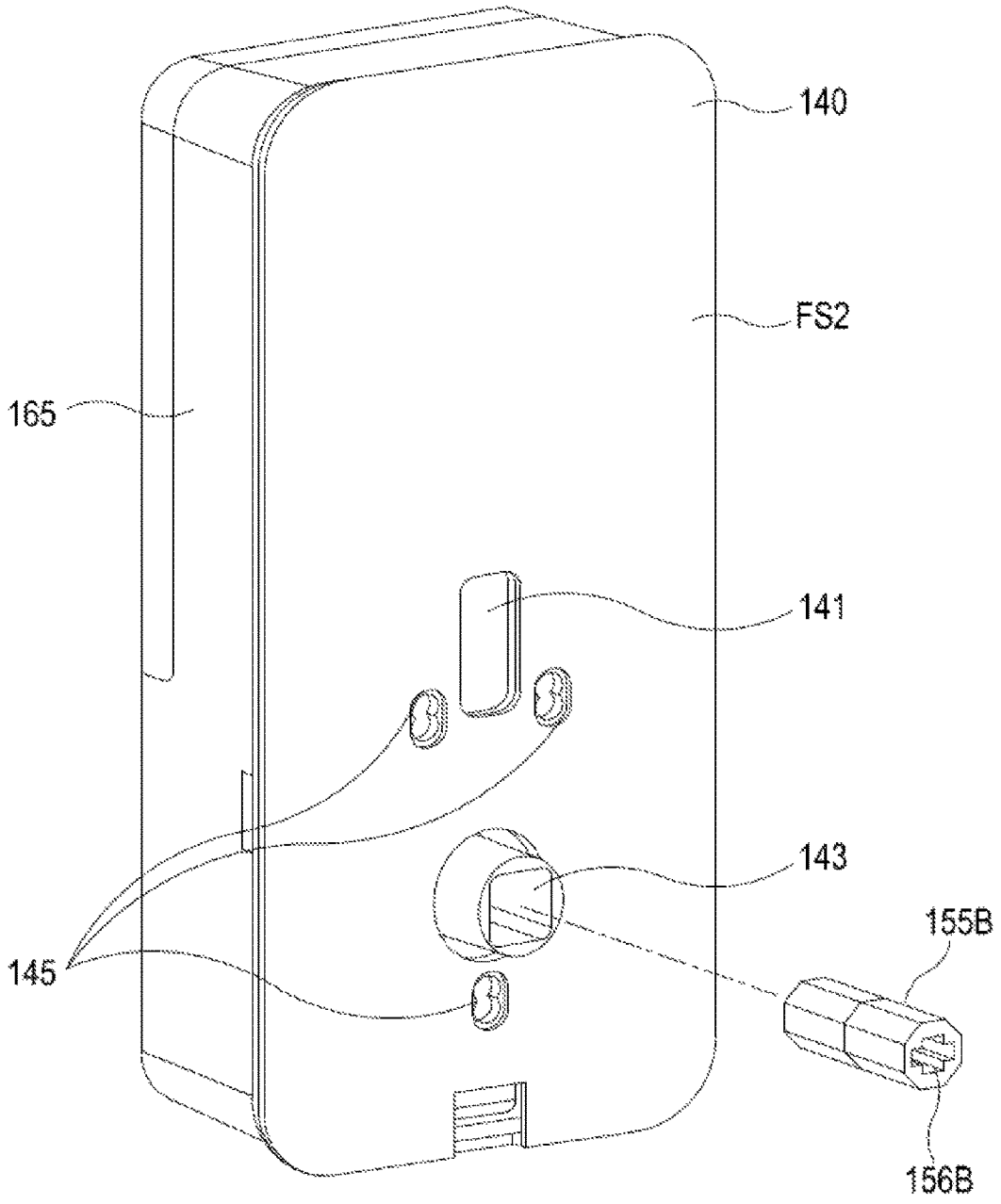
Figure 10:
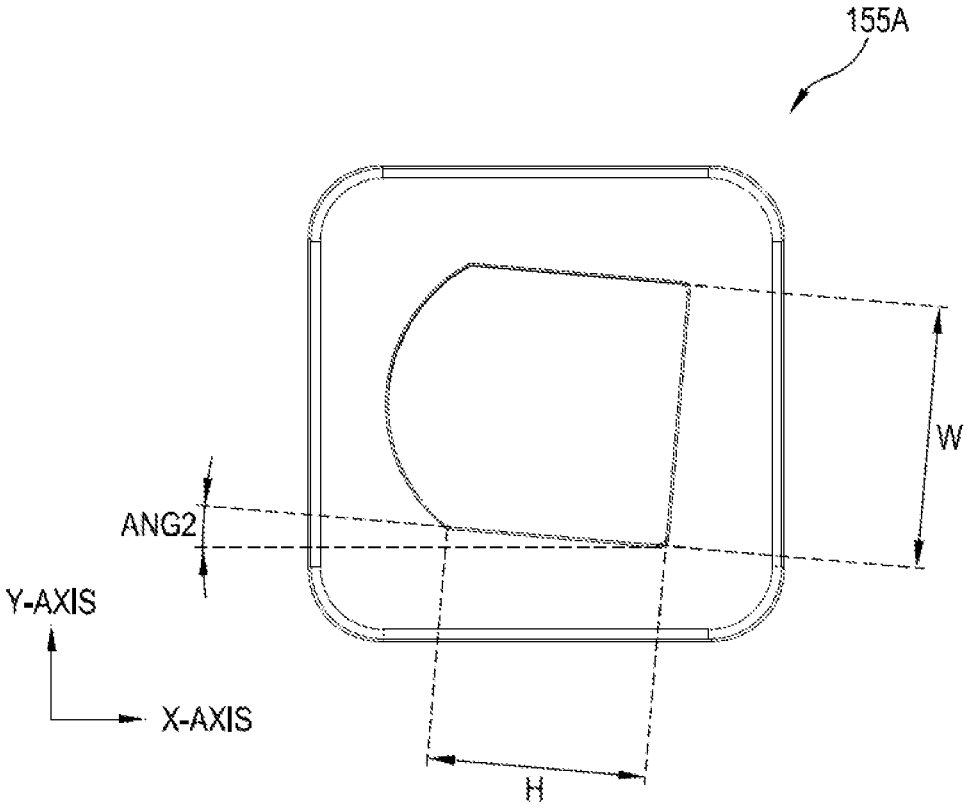
FIGS. 10 and 11 are exemplary diagrams of adapters included in the digital door lock assembly of FIG. 1.
Figure 11:
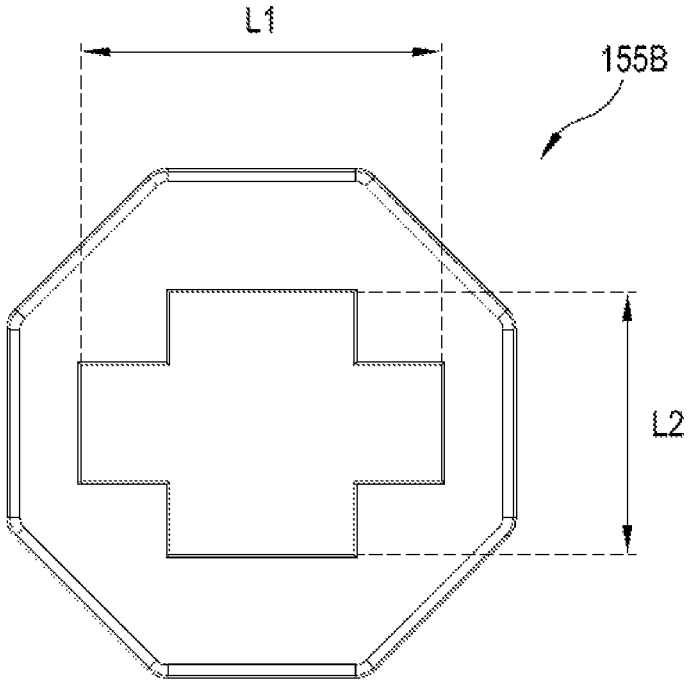

FIGS. 8 and 9 are views for describing a process of connecting an adapter to the inner plate assembly coupled with the interior assembly of the digital door lock assembly of FIG. 1, and FIGS. 10 and 11 are exemplary diagrams of adapters included in the digital door lock assembly of FIG. 1.

Adapters 155 include a first adapter 155A and a second adapter 155B. The material of each adapter 155A and 155B may be Zn. When the spindle 12 inserted into (or coupled with) the adapter 155A or 155B rotates, the adapter 155A or 155B may be used for rotation of an internal knob connected (or coupled) to the interior assembly 165 or a manual open/close button (or manual lock button) 166.

Since a user can appropriately select the adapter 155A or 155B into which the spindle 12 can be inserted even if the shape, length, and/or size of the spindle 12 of the key lock cylinder 10 vary depending on a manufacturer, a user can reuse the existing key lock cylinder 10 by coupling the digital door lock assembly 100 according to the exemplary embodiment of the present inventive concepts to the key lock cylinder 10 without discarding the existing key lock cylinder 10 separated from the door 20.

As shown in FIGS. 8 and 10, the first adapter 155A includes a twelfth hole 156A passing through the spindle 12 of the key lock cylinder 10. An inner shape of the cross section of the twelfth hole 156A is a D-type, and an angle ANG2 between a horizontal axis (or an X-axis) and an extension line of the height H of the D-type is 5° to 10°. An outer shape of the cross section of the first adapter 155A may be a square or a rounded rectangle.

As shown in FIGS. 9 and 11, the second adapter 155B includes a thirteenth hole 156B through which the spindle 12 of the key lock cylinder 10 passes. An inner shape of the cross section of the thirteenth hole 156B is a cross shape (+), and a ratio of a minor axis L2 to a major axis L1 (=L2/L1) of the cross shape may be 0.65 to 0.75. An outer shape of the cross section of the second adapter 155B may be octagonal.

When the shape of the spindle 12 is a (−) type or the spindle 12 is inclined at a predetermined angle ANG2 as shown in FIG. 10, a user can rotate the second adapter 155B having the thirteenth hole 156B by 45 degrees from a horizontal direction to be coupled with the spindle 12 for smooth compatibility and coupling between the spindle 12 and the second adapter 155B. In this case, the thirteenth hole 156B may be cross-shaped.

Only one of the two adapters 155A and 155B is coupled with the spindle 12 of the key lock cylinder 10. That is, the spindle 12 of the key lock cylinder 10 may be connected to the interior assembly 165 by fitting into the hole 156A or 156B formed in the adapter 155A or 155B. The compression spring 160 is disposed (or connected) between the adapter 155A or 155B and the interior assembly 165.

A sensor device 167 is attachable or detachable to or from the interior assembly 165, the sensor device 167 includes a sensor, a bar connected to the sensor, and a sliding device that is connected to the bar and is continuously moveable back and forth in accordance with an operation of a user while being connected to the bar. Since the surface of the bar is smooth, the sliding device can continuously move while being connected to the bar. Here, a term of "continuous" means not to be discrete.

The sliding device may be fixed (or fit to be fixed) to an edge of the interior assembly 165. After the sensor device 167 is fixed to the interior assembly 165 by the sliding device, a user can move the sensor connected to the bar back and forth continuously (or in an analog manner).

For example, the sensor device installed at a position corresponding to a magnet installed in the door 20 may be a magnetic sensor capable of sensing a change in a magnetic field of the magnet that varies with the door 20 being open or closed. For example, a distance between the magnetic installed in the door 20 and a sensor of the sensor device 167 may be adjusted in the analog manner in accordance with a movement of the sensor connected to the bar back and forth in the analog manner. Therefore, a user can minutely adjust the distance.

The third screws (or bolts) 170 fit or screw into screw holes formed in the inner plate assembly 140 to couple the interior assembly 165 with the inner plate assembly 140.

At least one battery 175 may supply operating voltages to components 112-1, 112-2, and 112-3 arranged (or formed) on a PCB 112 included in the exterior assembly 110 and/or a main controller included in the interior assembly 165.

The main controller may control operations of the RF chip 112-1, the controller chip 112-2, and/or the regulator 112-3, receive RF signals output from the RF chip 112-1 (for example, signals corresponding to a password) or signals generated in response to pressing of number keypads (or key-buttons) output from the controller chip 112-2 (for example, signals corresponding to a password), generate a password corresponding to the received signals, compare the generated password with a password set in advance by a user, and control the locking and unlocking of the digital door lock assembly 100 in accordance with a result of the comparison.

The battery cover 180 is a cover for covering and protecting at least one battery inserted into a battery case 168 of the interior assembly 165.

A user separates the existing key lock cylinder 10 installed in the door 20 from the door 20, and inserts the existing key lock cylinder 10 separated from the door 20 into the storage space SS of the housing of the exterior assembly 110 of the digital door lock assembly 100 according to an exemplary embodiment of the present inventive concepts.

Thereafter, a user selects one of a plurality of screw guides 130A, 130B, and 130C, and screws a selected screw guide into the first screw holes 14 of the key lock cylinder 10 using the first screws 135. Thereafter, the user fixes the exterior assembly 110 and the inner plate assembly 140 to the door 20 using the second screws 150.

The user selects one of the adapters 155A and 155B, inserts the spindle 12 which has passed through the first hole 118, an empty space of an arch portion of a selected screw guide 130A, 130B, or 130C, and the tenth hole 143 into the hole 156A or 156B of the selected adapter 155A or 155B, connects the compression spring 160 to the selected adapter 155A or 155B, and fixes the interior assembly 165 to the inner plate assembly 140 using the third screws 170.

The digital door lock assembly according to the exemplary embodiment of the present inventive concepts includes screw guides having various shapes to screw into screw holes formed in the key lock cylinder and adapters having various shapes to be coupled with a spindle of the key lock cylinder such that a user may reuse an existing key lock cylinder separated from a door.

Therefore, even if the shape and size of the spindle of the key lock cylinder are different depending on a manufacturer, a user can select an adapter suitable for the spindle among adapters and select a screw guide suitable for screw holes among screw guides, and thus the user can keep using the key lock cylinder without discarding it.

Moreover, a key lock cylinder of an existing door lock may be coupled with the digital door lock assembly according to the exemplary embodiment of the present inventive concepts, and therefore a user can use the digital door lock assembly instead of the existing door lock without processing the door or drilling an additional hole in the door.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A digital door lock assembly including an exterior assembly, the exterior assembly comprising:

a printed circuit board (PCB) which includes an RF chip for receiving and processing a radio frequency (RF) signal, a controller chip for receiving and processing signals output from number keypads, and a regulator supplying operating voltages to the RF chip and the controller chip, wires which are connected to the RF chip, the controller chip, and the regulator through the PCB;

a housing which has a storage space into which a key lock cylinder including a spindle and a plurality of first screw holes is inserted, and includes a first hole which the spindle passes through and a plurality of second holes, wherein the first hole and the plurality of second holes are formed at a bottom of the storage space;

a first screw guide which includes a plurality of third holes; and a second screw guide which includes a plurality of fourth holes, wherein each of the plurality of third holes has a circular shape, and each of the plurality of fourth holes has an elliptical shape.

2. The digital door lock assembly of claim 1, wherein an angle between a major axis and a vertical axis of the elliptical shape of the second screw guide is 35 to 45 degrees.

3. The digital door lock assembly of claim 1, wherein the major axis of the elliptical shape of the second screw guide is in a vertical direction.

4. The digital door lock assembly of claim 1, further comprising:

a plurality of screws, wherein the plurality of screws screw the first screw guide into the plurality of first screw holes of the key lock cylinder through the plurality of third holes and the plurality of second holes when the first screw guide is used, and the plurality of screws screw the second screw guide into the plurality of first screw holes of the key lock cylinder through the plurality of fourth holes and the plurality of second holes when the second screw guide is used.

5. The digital door lock assembly of claim 1, further comprising:

a plurality of second screw holes formed in a protruding portion of a rear surface of the exterior assembly; and an inner plate assembly, wherein the inner plate assembly further including:

a fifth hole having a structure in which the spindle passing through the first hole passes therethrough;

a plurality of sixth holes each having a peanut shape; and a plurality of screws, wherein the plurality of screws screw into the plurality of second screw holes through the plurality of sixth holes.

6. The digital door lock assembly of claim 4, further comprising:

a first adapter which includes a fifth hole; and a second adapter which includes a sixth hole, wherein the spindle passes through the fifth hole of the first adapter when the first adapter is used, the spindle passes through the sixth hole of the second adapter when the second adapter is used, the fifth hole and the sixth hole are different from each other in shape.

7. The digital door lock assembly of claim 6, further comprising:

a compression spring disposed between one of the first adapter and the second adapter and an interior assembly.

8. The digital door lock assembly of claim 6, wherein a material of each of the first adapter and the second adapter is Zn.

9. The digital door lock assembly of claim 6, wherein an inner shape of the cross section of the fifth hole is D-type, and an inner shape of the cross section of the sixth hole is a cross shape.

10. The digital door lock assembly of claim 9, wherein an outer shape of the first adapter is quadrangular or a rounded square, and an outer shape of the second adapter is octagonal.

11. The digital door lock assembly of claim 9, wherein an angle between a horizontal axis and an extension line of the height of the fifth hole of the D-type is 5 to 10 degrees.

12. The digital door lock assembly of claim 9, wherein a ratio of a minor axis to a major axis of the cross shape is 0.65 to 0.75.

13. A digital door lock assembly comprising:
an exterior assembly which is installed outside a door;
an inner plate assembly which is installed inside the door and connected to the exterior assembly; and
an interior assembly which is connected to the inner plate assembly;
a first screw guide;
a second screw guide;
a plurality of first screws;
a first adapter; and
a second adapter,
wherein the exterior assembly including:
a PCB that includes an RF chip for receiving and processing an RF signal, a controller chip for receiving and processing signals output from number keypads, and a regulator for supplying operating voltages to the RF chip and the controller chip;
wires that are connected to the RF chip, the controller chip, and the regulator through the PCB; and
a housing that has a storage space into which a key lock cylinder including a spindle and a plurality of first screw holes is inserted, and includes a first hole through which the spindle passes and a plurality of second holes,
the first screw guide includes a plurality of third holes each having a circular shape,
the second guide includes a plurality of fourth holes each having an elliptical shape,
the first adapter includes a fifth hole through which the spindle passes,
the second adapter includes a sixth hole through which the spindle passes,
the first hole and the plurality of second holes are formed at a bottom of the storage space,
the plurality of first screws screw the first screw guide into the plurality of first screw holes of the key lock cylinder through the plurality of third holes and the plurality of second holes when the first screw guide is used,
the plurality of first screws screw the second screw guide into the plurality of first screw holes of the key lock cylinder through the plurality of fourth holes and the plurality of second holes when the second screw guide is used,
the spindle passes through the first hole and the fifth hole when the first adapter is used, and
the spindle passes through the first hole and the sixth hole when the second adapter is used.

14. The digital door lock assembly of claim 13, further comprising:
a plurality of second screws;
a plurality of second screw holes that are formed in a protruding portion of a rear surface of the exterior assembly;
a seventh hole that is formed in the inner plate assembly and has a structure in which the spindle passes therethrough; and
a plurality of eighth holes that are formed in the inner plate assembly and each has a peanut shape, and
the plurality of second screws screw into the plurality of second screw holes through the plurality of eighth holes.

15. The digital door lock assembly of claim 14,
wherein an inner shape of the cross section of the fifth hole is D-type, an inner shape of the cross section of the sixth hole is a cross shape, an outer shape of the first adapter is quadrangular or a rounded square, and an outer shape of the second adapter is octagonal.

16. A digital door lock assembly comprising:
an exterior assembly which is installed on an exterior surface of a door;
an inner plate assembly which is installed on an interior surface of the door and is connected to the exterior assembly; and
an interior assembly which is connected to the inner plate assembly;
a first screw guide;
a second screw guide;
a plurality of first screws;
a first adapter; and
a second adapter,
wherein the exterior assembly including:
a storage space into which a key lock cylinder including a spindle and a plurality of first screw holes is inserted;
a first hole through which the spindle passes; and
a plurality of second holes,
the first screw guide includes a plurality of third holes each having a circular shape,
the second guide includes a plurality of fourth holes each having an elliptical shape,
the first adapter includes a fifth hole through which the spindle passes,
the second adapter includes a sixth hole through which the spindle passes,
the first hole and the plurality of second holes are formed at a bottom of the storage space,
the plurality of first screws screw the first screw guide into the plurality of first screw holes of the key lock cylinder through the plurality of third holes and the plurality of second holes when the first screw guide is used,
the plurality of first screws screw the second screw guide into the plurality of first screw holes of the key lock cylinder through the plurality of fourth holes and the plurality of second holes when the second screw guide is used,
the spindle passes through the first hole and the fifth hole when the first adapter is used, and
the spindle passes through the first hole and the sixth hole when the second adapter is used.

17. The digital door lock assembly of claim 16, further comprising:
a sensor device which is connected to the interior assembly,
wherein the sensor device including:
a sensor;
a bar connected to the sensor; and
a sliding device that is connected to the bar, and is moveable back and forth in an analog manner in accordance with an operation of a user while being connected to the bar.

* * * * *